United States Patent [19]

English et al.

[11] 4,206,963

[45] Jun. 10, 1980

[54] CONNECTOR FILTERED ADAPTER ASSEMBLY

[75] Inventors: Keith H. English, Middle Paxton Township, Dauphin County; Edgar W. Forney, Jr., Harrisburg; Michael F. O'Keefe, Mechanicsburg, all of Pa.

[73] Assignee: AMP, Incorporated, Harrisburg, Pa.

[21] Appl. No.: 31,901

[22] Filed: Apr. 20, 1979

[51] Int. Cl.[2] ..... H01R 13/66

[52] U.S. Cl. ..... 339/147 R; 339/154 A

[58] Field of Search ..... 339/147, 154, 154 A, 339/153

[56] References Cited

U.S. PATENT DOCUMENTS

| | | | |
|---|---|---|---|
| 3,281,558 | 10/1966 | Weber | 339/154 R |
| 3,663,929 | 5/1972 | Miertschin et al. | 339/147 R |
| 3,678,444 | 7/1972 | Stevens et al. | 339/177 R |
| 3,703,701 | 11/1972 | Zimmerman, Jr. | 339/147 R |
| 3,721,869 | 3/1973 | Paoli | 339/147 R |
| 3,936,132 | 2/1976 | Hutter | 339/177 R |
| 4,029,386 | 6/1977 | Krantz, Jr. et al. | 339/143 R |
| 4,079,343 | 3/1978 | Nijman | 339/147 R |

*Primary Examiner*—John McQuade

*Attorney, Agent, or Firm*—Richard B. O'Planick; J. L. Seitchik

[57] ABSTRACT

A filtered adapter assembly is disclosed for retrofitting electronic filtering elements between matable coaxial connector units, and comprises a contact sub-assembly, tubular adapting means including an adapter shell, a conductive retention ring, and a pair of dielectric inserts. The contact sub-assembly includes a ceramic filter sleeve having a pin extending therethrough and a flanged collar around the filter sleeve. The adapter shell is provided with a step profiled throughbore receiving the contact sub-assembly therein with clearance, and the retention ring is press-fit into the bore against the collar flange to secure the sub-assembly within the bore, and to electrically common the sub-assembly filter sleeve and the adapter shell. The dielectricinserts are subsequently inserted into the adapter shell with alternate ends of the sub-assembly pin extending therethrough to insulate the pin from the adapter shell.

10 Claims, 9 Drawing Figures

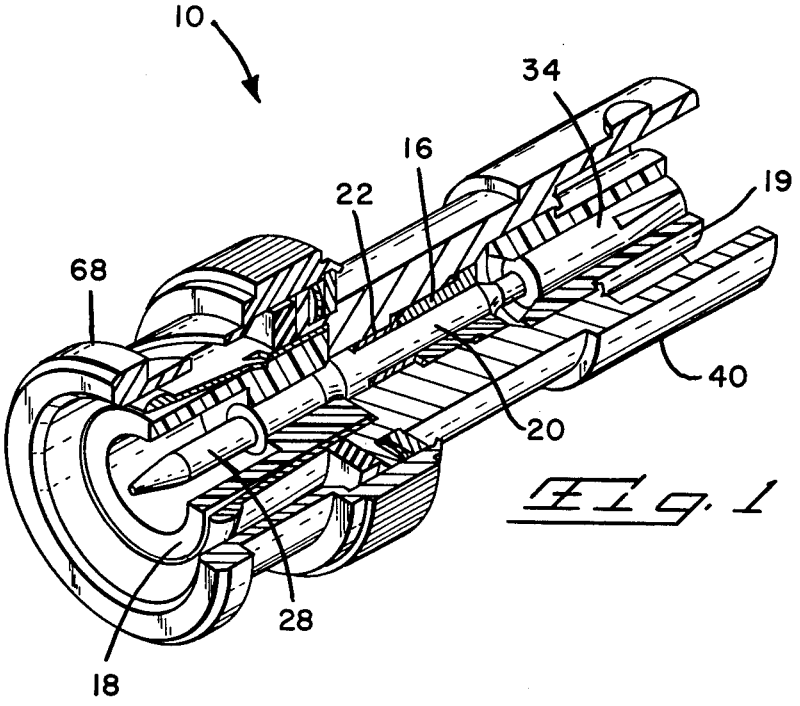
Fig. 1
Fig. 2
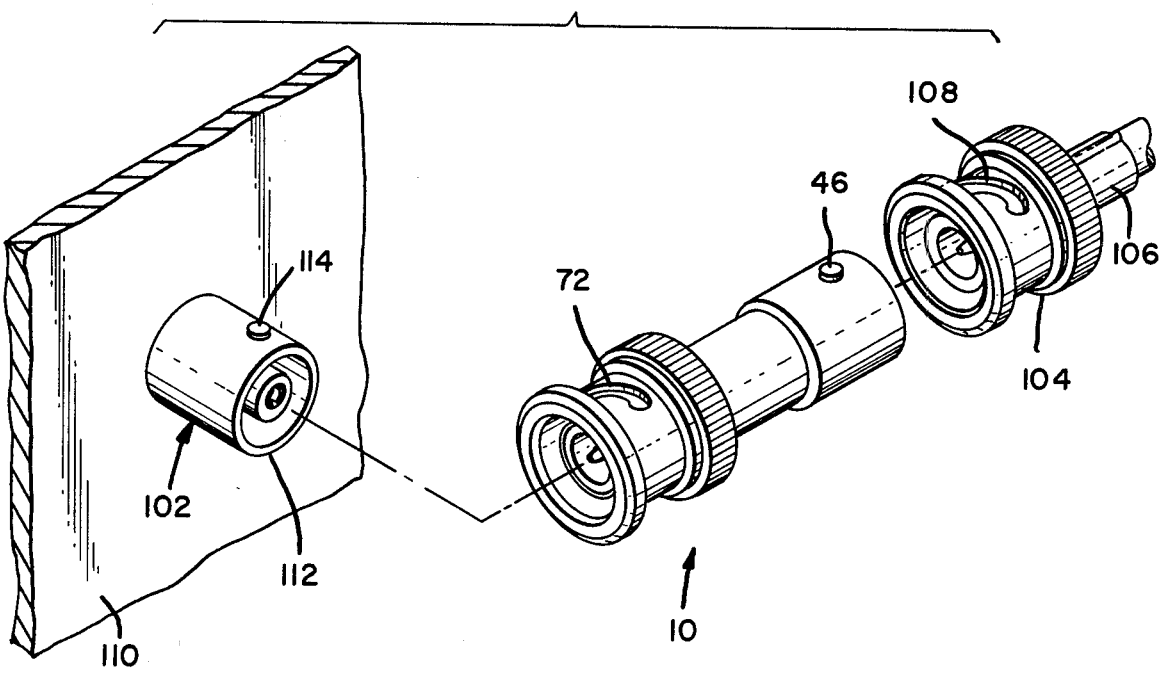

CONNECTOR FILTERED ADAPTER ASSEMBLY

BACKGROUND OF THE INVENTION

1. Field of the Invention

This invention relates generally to electronically filtered connectors, and more particularly to filtered adapter assemblies and filtered jacks in a coaxial configuration.

2. Description of the Prior Art

Electronic filters are well-known within the industry and are used to selectively attenuate certain signals in transmission lines by shunting unwanted signal frequencies to ground. Typically, such filters are of a fragile ceramic construction and as such have heretofore been difficult to incorporate into a coaxially configured connector design. Consequently, many coaxial connectors are used in the field in applications which should, but do not, have filter elements for filtering out unwanted electromagnetic interference. Specifically, the industry is in need of a coaxial filtered adapter for retrofitting mating coaxial connector units with a filtering capability. Prospectively, the industry is in need of a filtered jack assembly as an interface to instruments requiring filter protection.

One problem has been how to mechanically insulate the filter within an adapter from externally originating forces which would crack the filter causing a malfunction. Isolation of the filter sleeve, however, can not be attained at the sacrifice of good electrical contact between the filter and the adapter shell, for positive grounding contact is imperative in any filterized coaxial adapter approach. Moreover, from an ecomonic standpoint, it is desirable that any filtered adapter have a minimal number of parts to facilitate ease of assembly, and the adapter parts should be standardized as much as possible to reduce cost. Standardization of adapter parts is difficult because a coaxial adapter must accommodate receipt of filters of varying size since different electronic applications require the use of filters of differing lengths.

The industry's effort to resolve the above heretofore irreconcilable constraints on any proposed coaxial filtered adapter have met with mixed results. One connector approach is disclosed in U.S. Pat. No. 4,029,386, and comprises a plastic metal-coated ground wafer having integral tines for engaging filtered terminals encapsulated within elastomeric inserts. While this connector works well and has been well received by the industry, certain problems attendant upon its use prevent the connector from representing an ideal solution. As stated above, mechanical insulation of a filter sleeve within a connector or adapter must be provided, and positive contact between an adapter shell and the filter therein beyond that achieved by a tine configuration is required.

SUMMARY OF THE INVENTION

The present invention relates to a filtered adapter assembly for retrofitting electronic filtering elements between two matable coaxial connector units, and comprises a contact sub-assembly, a tubular adapter shell, a conductive retention ring, and a pair of dielectric inserts. The contact sub-assembly includes a ceramic filter sleeve having a pin extending therethrough and a flanged collar provided around the filter sleeve. The adapter shell is provided with a step profiled throughbore dimensioned slightly larger than the filter sleeve diameter. The contact sub-assembly is inserted into the bore and the retention ring subsequently press-fit into the bore against the flange of the collar. There positioned, the retention ring retains the contact sub-assembly within the bore and electrically commons the filter sleeve to the adapter shell. The dielectric inserts are subsequently inserted into the adapter shell to insulate alternate ends of the pin from the adapter shell.

Accordingly, it is an object of the present invention to provide a filtered adapter assembly for retrofitting electronic filtering elements between two mateable coaxial connector units.

Another object of the present invention is to provide a filtered adapter assembly which can mechanically insulate a contact sub-assembly therein from externally originating stress.

A further object of the present invention is to provide a coaxial filtered adapter assembly having means for retaining a contact sub-assembly therein and establishing positive contact between the sub-assembly filter and the adapter shell.

A still further object of the present invention is to provide a filtered adapter assembly accommodating a contact sub-assembly having a filter element of variable dimension.

Still another object of the present invention is to provide a coaxial filtered adapter assembly having internal means for electrically insulating filter elements from alternate ends of a center pin.

A still further object of the present invention is to provide a coaxial filtered adapter assembly which is readily and economically produced, and readily assembled.

These and other objects which will be apparent to one skilled in the art are achieved by a preferred embodiment of the instant invention which is described in detail below and illustrated in the accompanying drawings.

BRIEF DESCRIPTION OF THE DRAWINGS

FIG. 1 is a perspective view partially in section of the subject filter-pin adapter assembly.

FIG. 2 is a perspective view of the subject filtered adapter assembly positioned as intended between a coaxial cable and an instrument jack.

DETAILED DESCRIPTION OF THE PREFERRED EMBODIMENT

Figure 3:
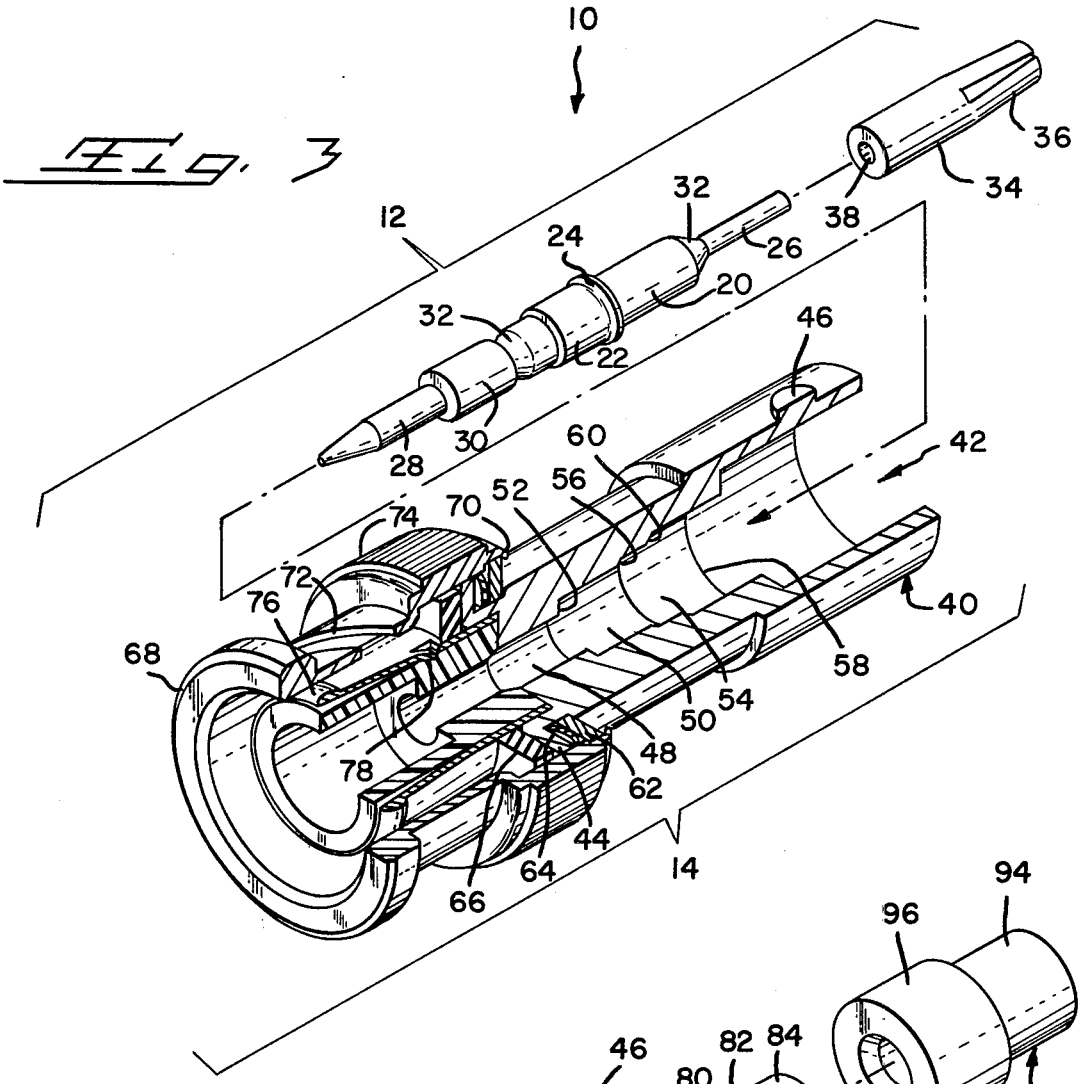
FIG. 3 is an exploded perspective view of the subject adapter shell and the filtered sub-assembly.
Figure 4:
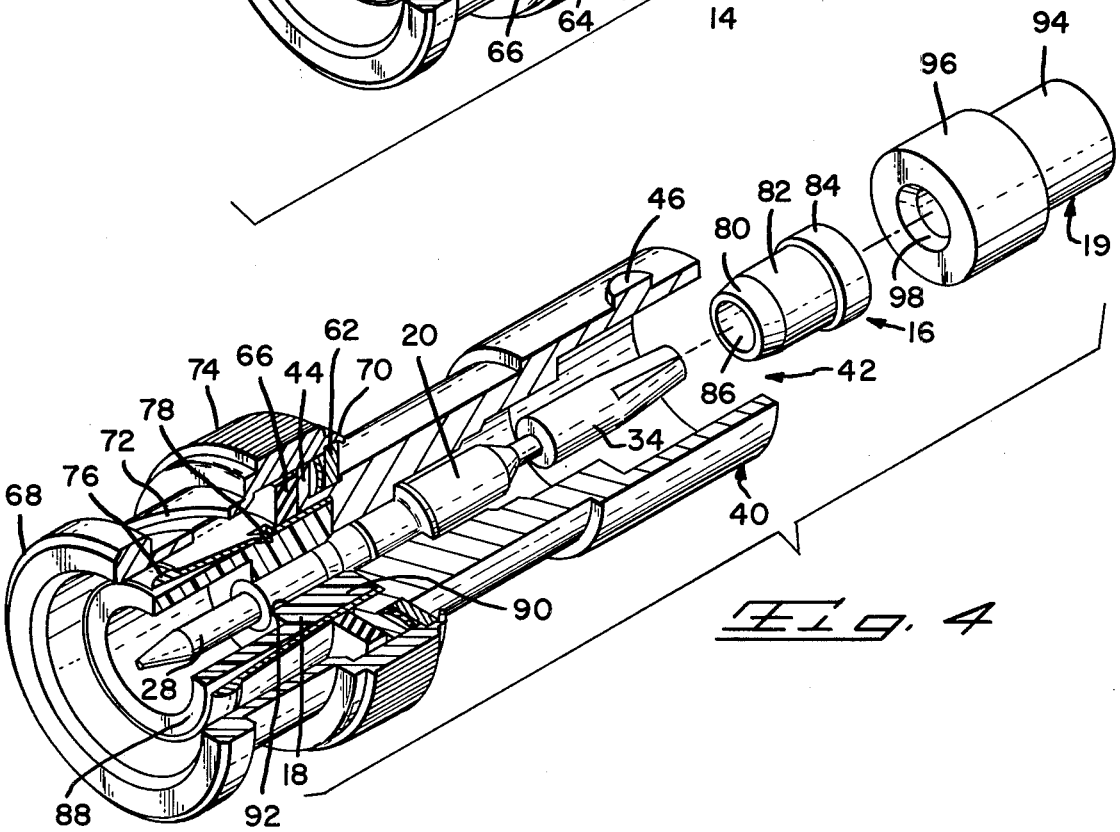
FIG. 4 is an exploded perspective view of the adapter shell and the sub-assembly therein, with the retaining ring and dielectric insert exploded therefrom.

Referring first to FIGS. 3 and 4, the subject filtered adapter assembly 10 is shown to comprise a contact sub-assembly 12, an adapter assembly 14, a retaining ring 16, and a pair of dielectric inserts 18,19. The contact sub-assembly 12 includes a filter sleeve 20 having a collar 22 therearound, with the collar 22 further having an external annular flange 24. A pin member 26 is provided extending through the filter sleeve 20, and comprises a forward tapered nose portion 28, and a forward shoulder portion 30. The pin member 26 is secured within the sleeve 20 in electrical engagement therewith, and dielectric plastics material 32 is provided at alternate ends of the filter sleeve 20 to seal the filter-pin interface. As shown in FIGS. 3 and 4, a rearward receptacle member 34 is included in the sub-assembly 12 and comprises a socket portion 36 and an axial bore 38 therethrough. The receptacle 34 is intended to receive a rearward end of the pin 26 within the bore 38 and electrical contact therebetween is established by soldering or the like. It should be noted that the receptacle member 34 is mateably configured with respect to the pin tapered nose portion 28 for the subject adapted assembly to provide a retrofitting function as explained below.

The adapter assembly 14 comprises an adapter shell 40 having a step profiled bore 42 therethrough, an external annular flange 44 at a forward end, and an external bayonet projection 46 at a rearward end. As shown best by FIG. 3, the bore 42 is provided with a relatively small first portion 48, an intermediate second portion 50 of larger diameter joined to the first portion by a step 52, a still larger third portion 54 joined to the second portion 50 by a step 56, and a still larger fourth portion 58 joined to the third portion 54 by a step 60. The adapter assembly 14 further comprises a split washer 62 and a spring washer 64 rearward of the adapter shell flange 44, and a gasket 66 forward of the adapter shell flange 44. Continuing, a BNC style collar 68 is provided at the forward end of the assembly having an inward annular locking lip 70 in engagement with the split washer 62. The collar 68 further includes a camming slot 72 and a grooved shoulder 74 which facilitates easy manual gripping of the assembly 14. A funnel-shaped plug shell 76, inserted into a forward end of the adapter shell 40 and soldered thereto, is provided with a latching barb 78 functioning in a manner explained below.

With continuing reference to FIGS. 3 and 4, the assembly retaining ring 16 has a tapered forward end 80, a central body portion 82, an enlarged shoulder 84, and an axial bore 86 therethrough dimensioned slightly larger than the filter sleeve 20 diameter. The forward dielectric insert 18 comprises a hooded portion 88 and a smaller body portion 90 with a bore 92 through the body portion 90. The rearward dielectric insert 19 comprises a relatively small hooded portion 94, a larger body portion 96 having a bore 98 therethrough.

Figures 5, 6, 7:
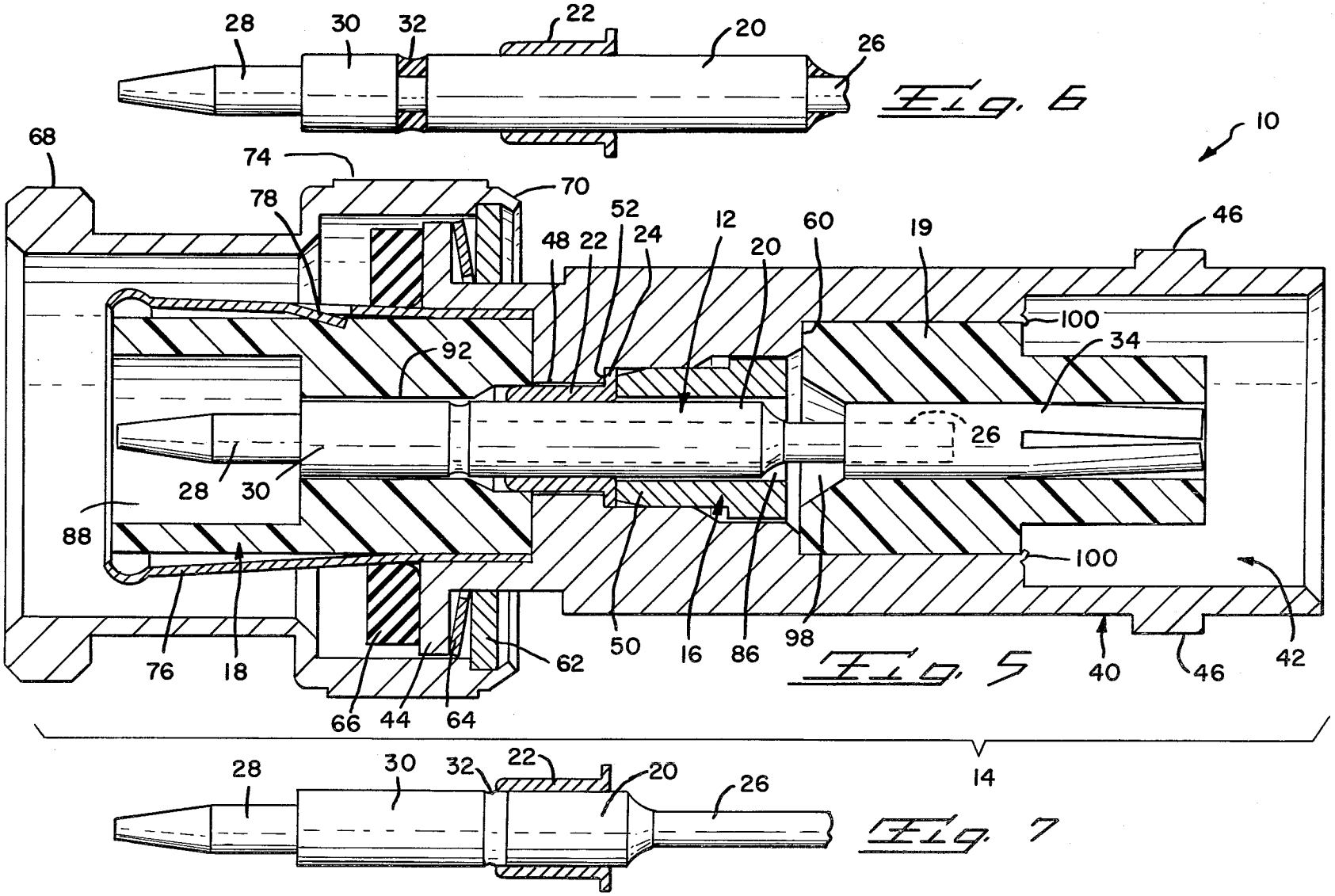
FIG. 5 is a side elevation view partially in section of the adapter assembly shown in FIG. 1.
FIG. 6 is a side elevation view of an alternative filtered sub-assembly.
FIG. 7 is a side elevation view of an alternative filtered sub-assembly.

Assembly of the instant adapter is sequentially illustrated in perspective in FIGS. 1, 3 and 4, and the complete assembly is illustrated in transverse section by FIG. 5. Referring first to FIGS. 4 and 5, the forward dielectric insert 18 is pre-inserted into the plug shell 76 against the adapter shell 40, and the latching barb 78 engages the insert 18 to retain the insert within the plug shell. The contact sub-assembly 12 is then inserted into the adapter assembly bore 42 with the collar annular flange 24 in abuttment against the step 52. The first bore portion 48 is dimensioned to receive with clearance the filter sleeve 20 having the collar 22 therearound. Further, the forward dielectric bore 92 is dimensioned to receive with clearance the forward pin shoulder 30 therethrough as the tapered pin portion 28 projects into the dielectric hooded portion 88.

Assembly continues with the retention collar 16 press-inserted into the adapter bore 42, and a forward end of the retention collar presses the annular flange 24 of the contact sub-assembly against the step 52. It will be appreciated that the retention collar body portion 82 frictionally engages the sidewalls of the second bore portion 50 to establish electrical contact between the annular flange 24 and the adapter shell 40, and also to secure the sub-assembly 12 within the bore 42. The retention collar bore 86 is dimensioned to receive with clearance the filter sleeve 20. The final step in the assembly procedure is insertion of the rearward dielectric insert 19 into the third adapter assembly bore portion 58 with the forward end of the insert abutting the step 60. The rearward insert bore 98 is dimensioned to receive therethrough with clearance the rearward receptacle 34 of the contact sub-assembly 12. Subsequently, internal portions of the adapter shell, indicated at 100 of FIG. 5, are staked into the insert by suitable tooling (not shown) in a manner common within the industry. The insert is thereby secured within the adapter shell and assembly of the adapter is thereby complete.

The assembled adapter assembly is illustrated by FIGS. 1 and 5. It will be appreciated that the filter sleeve 20 does not contact the internal sidewalls of the adapter assembly bore except through the annular flange of the collar. This effectuates mechanical insulation of the fragile filter sleeve from externally originating stress, yet does not sacrifice electrical contact since the filter sleeve is securely commoned to the adapter shell through the annular collar flange. It will further be appreciated that the forward and rearward dielectric inserts 18, 19 electrically insulate the forward and rearward portions 28, 34 of the pin from the adapter assembly 14.

Referring to FIGS. 5, 6 and 7, the instant adapter assembly 10 is intended to accommodate a contact sub-assembly filter sleeve having a length variable within limits. Because different filtering applications require use of filters of differing lengths, this capability greatly enhances the versatility of the adapter assembly. FIG. 5 illustrates a contact sub-assembly 12 having a filter sleeve 20 of intermediate length; FIG. 6 a contact sub-assembly filter sleeve 20 of larger length; and FIG. 7 a contact sub-assembly filter sleeve 20 of smaller length. It should be noted that the adapter assembly 14 can accommodatingly receive any one of the contact sub-assemblies of FIGS. 5, 6 and 7, since the dimensional tolerance requirements of the adapter assembly are satisfied if the axial distance between the pin forward end 28 and the rearward receptacle portion end 34 remains constant, and if the annular collar flange 24 is located a prescribed distance between the ends of the pin. That is, so long as the overall axial length of the contact sub-assembly 12 remains the same and the collar flange 24 is fixedly positioned a predetermined distance between the ends of the sub-assembly, the contact sub-assembly can have a filter sleeve of varying length within limits and still be compatible with the adapter assembly 14. Thus, one adapter assembly 14 can be manufactured and used in conjunction with sub-assemblies having varying filter sleeve sizes. It should be noted that the size of the first bore portion 48, the retention collar bore 86, and the dielectric bores 92, 98 enables accommodation of filters of varying lengths without interference.

Referring now to FIG. 2, the subject adapter assembly 10 is intended to be used to retrofit filtering capability between two coaxial connector units 102, 104, representatively shown to be a jack and plug. The plug unit 104 is connected to a coaxial cable 106 and has a BNC-style profiled forward end having a bayonet camming slot 108. The forward slot 108 is adapted to receive the stud 46 of the filtered adapter assembly 10 as the plug unit forward end engagingly receives the rearward end of the filtered adapter assembly therein. The jack unit 102 is mounted into a panel 110 and has a profiled end 112 having an external bayonet stud 114. The bayonet stud is received within the slot 72 of the adapter assembly 10 as the adapter assembly and jack are matingly engaged. While the subject adapter assembly 10 is illustrated as retrofitting a plug and jack combination, it should be appreciated that the adapter assembly 10 could also have application in retrofitting other types of mateable coaxial connector units.

Figure 8:
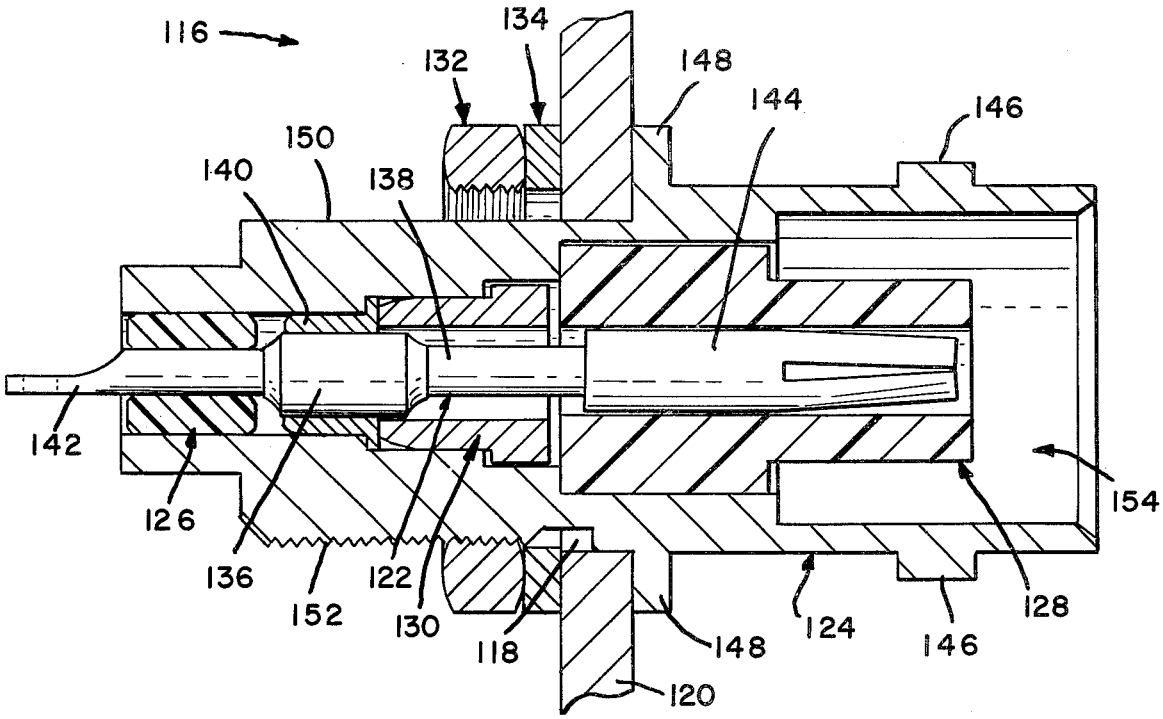
FIG. 8 is a side elevation view partially in section of an alternative panel mounted jack embodying the principles of the subject invention.

FIG. 8 illustrates an alternative panel jack assembly 116 embodying the principles of the subject invention. The panel jack assembly 116 is intended to provide filtering at an instrument's external electrical interface, and is adapted for extension through a profiled aperture 118 within a panel 120. The panel jack assembly 116 comprises a contact sub-assembly 122, and outer shell member 124, forward and rearward dielectric inserts 126, 128, a retention collar 130, and a mounting nut 132 and washer 134. The sub-assembly 122 includes a filter sleeve 136, a pin 138, and a flanged collar 140 assembled in the manner described above. The pin 138 further includes a forward solder tab portion 142 and a rearward receptacle portion 144.

The metallic shell member 124 is provided with external bayonet studs 146; an external annular flange 148 for engaging portions of the panel 120 defining the aperture 118; an upper flattened surface 50; and a threaded peripheral surface 152. That is, the metallic shell member 124 is D-shaped at the forward end to preclude rotational movement within the aperture 118. The shell member 124 further includes a step profiled bore 154 extending therethrough generally profiled in the manner set forth for the adapter assembly described above.

Figure 9:
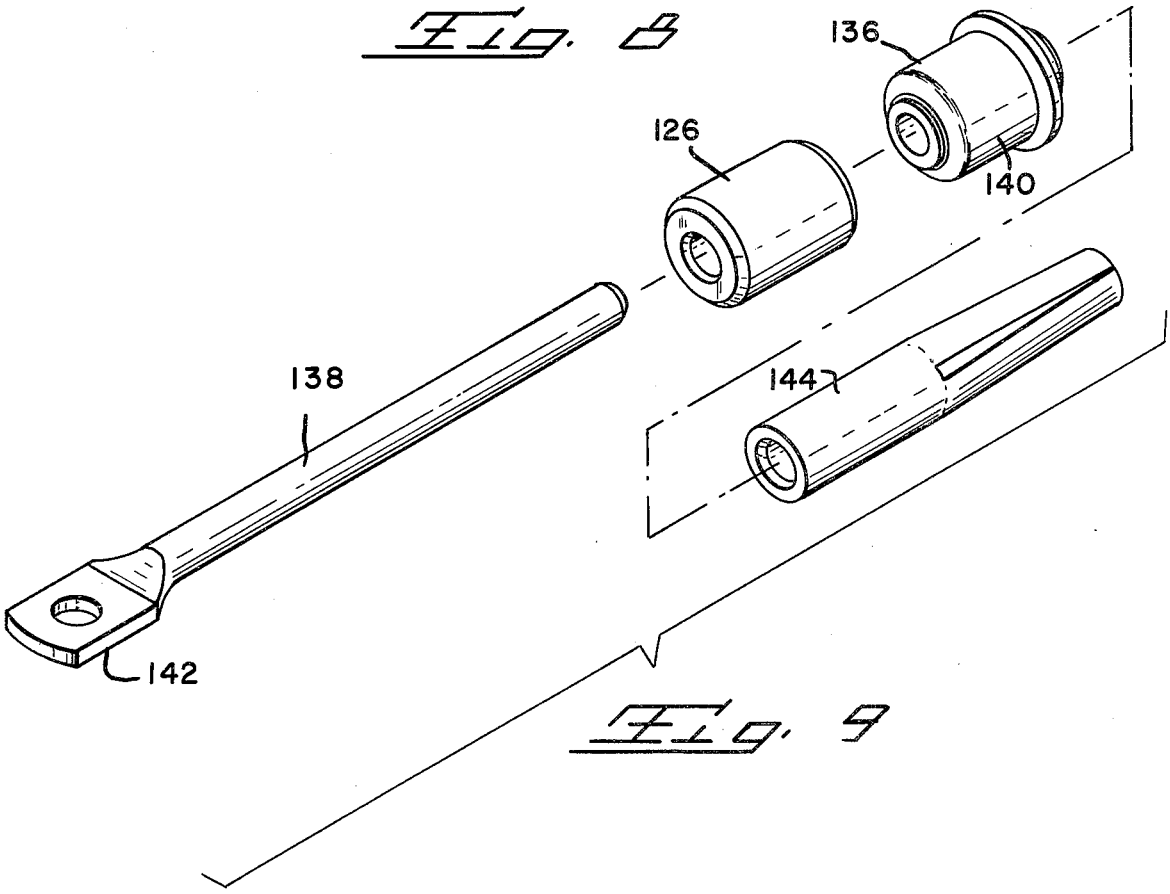
FIG. 9 is an exploded perspective view of the filtered sub-assembly of the jack shown in FIG. 8.

Referring to FIG. 9, assembly of the contact sub-assembly is initiated by the insertion of the pin 138 through the forward dielectric insert 126, which is positioned in abuttment against the tab 142, and through the filter sleeve 136 having the collar 140 therearound. The receptacle portion 144 is affixed to the rearward end of the pin 138 and pin-to-filter, and pin-to-receptacle electrically contacting engagement is effected by soldering or the like.

With reference to FIG. 8, assembly of the subject jack assembly proceeds as described above, beginning with insertion of the contact sub-assembly into the bore 154 abutting the annular flange of the collar 130 against an internal step, followed by press insertion of the retention collar 130 into the bore against the collar flange, and concluding with insertion of the rearward dielectric insert 128 into the rearward end of the bore and staking the insert therein as explained above. Fully assembled, the retention collar commons the shell member 124 to the filter sleeve 136, and the dielectric inserts insulate the ends of the pin 138 from the shell member 124. The completed jack assembly is then inserted through the aperture 118 which is profiled to accommodate only a polarized insertion of the jack assembly therethrough. The flat surface 150 prevents rotation of the jack assembly within the aperture 118. The washer 134 and the nut 132 are then mounted to secure the jack assembly within the panel. It should be noted that the subject filtered jack assembly can, like the filtered adapter assembly, accommodate filter sleeves of differing lengths so long as the pin end to collar flange dimensions remain the same. Also, the filter sleeve is mechanically insulated and only contacts the shell member through the collar 130 annular flange. The filter is, therefore, grounded to the panel 120, and internal contact to the solder tab pin portion 142 can be effected to complete electrical connection between the jack assembly and the corresponding electrical instrument.

While the above description of the preferred and alternative embodiments exemplifies the principles of the subject invention, other embodiments which will be apparent to one skilled in the art and which utilize the teachings herein set forth are intended to be within the scope and spirit of the subject invention.

What is claimed is:

1. A filtered connector assembly for electrically connecting first inward and outward contact means to second inward and outward contact means respectively, and filtering selective elements of the signal transmitted between the resultingly connected first and second inward contact means, said assembly comprising:

an inner sub-assembly comprising:

a pin having a forward mating portion for engaging the first inward contact means, an intermediate portion, and a rearward mating portion for engaging the second inward contact means;

a filter sleeve having a bore therethrough receiving said pin intermediate portion in electrical engagement therewith; and a conductive filter collar receiving said filter sleeve therethrough in electrical engagement with said filter sleeve and having external annular flange means;

a conductive retaining ring having a bore therethrough slightly larger than said filter sleeve and receiving said intermediate pin portion rearward of said annular collar flange means therethrough; and a tubular conductive shell having generally forward profiled means for engaging the first outward contact means and rearward profiled means for engaging the second outward contact means, and having a bore therethrough of stepped profile along the length thereof comprising a first portion of small diameter receiving a forward end of said filter collar therein, and a second portion of a larger diameter joined to said first portion by a first annular step with said annular flange means of said filter collar abutting said first annular step, and said retaining ring securely positioned in said second portion of said bore with a forward end of said retaining ring engaging said annular flange means of said collar, and with outer surfaces of said retaining ring engaging inner walls of said shell to electrically common said shell and said filter sleeve.

2. The filtered connector assembly according to claim 1 wherein said first portion of said tubular shell bore has a dimension slightly larger than the diameter of said filter collar to accommodate receipt, with clearance, of said forward end of said filter collar therein.

3. The filtered connector assembly according to claim 1 wherein said bore of said tubular shell having a hooded portion forward of said first smaller diameter portion and a hooded portion rearward of said second larger diameter portion, and said assembly further comprising forward dielectric insert means within said forward hooded portion and having a bore receiving a pin portion forward of said filter sleeve therethrough, and rearward dielectric insert means within said rearward hooded portion and having a bore receiving a pin portion rearward of said filter sleeve therethrough, whereby said forward and rearward pin portions are electrically insulated from said tubular shell.

4. The filtered connector assembly according to claim 3, said bore through said forward dielectric insert means being dimensioned slightly larger than the diameter of said filter sleeve to accommodate receipt of a forward end of said sleeve therein.

5. The filtered connector assembly according to claim 1, said inner sub-assembly further comprising dielectric plastics material means at opposite ends of said filter sleeve to seal the interface between said filter sleeve ends and said pin.

6. The filtered connector assembly according to claim 1, said forward profiled means of said tubular shell comprising a collar member having bayonet receiving slot means for receiving a bayonet protrusion of the first outward contact means, and said rearward profiled means of said tubular shell having a bayonet protrusion receivable into receiving slot means of the second outward contact means.

7. The filtered assembly according to claim 6, said forward mating portion of said pin comprising a tapered nose portion and said rearward mating portion of said pin comprising a receptacle socket.

8. The filtered connector assembly according to claim 1, the first outward contact means comprising a bulkhead or the like having an aperture receiving said tubular shell therethrough, and said forward profiled means of said tubular shell comprising an external annular flange for abutting portions of the bulkhead defining the aperture.

9. The filtered connector assembly according to claim 8, said forward mating portion of said pin comprising solder tab means, and said rearward mating portion of said pin comprising a receptacle socket.

10. A filtered connector assembly for electrically connecting first inward and outward contact means to second inward and outward contact means respectively, and filtering selective elements of the signal transmitted between the resultingly connected first and second inward contact means, said assembly comprising:

an inner sub-assembly comprising:

a pin having a forward mating portion for engaging the first inward contact means, an intermediate portion, and a rearward mating portion for engaging the second inward contact means;

a filter sleeve having a bore therethrough for receiving said pin intermediate portion in electrical engagement therewith; and a conductive filter collar for receiving said filter sleeve therethrough in electrical engagement with said filter sleeve and having external annular flange means;

a conductive retaining ring having a bore therethrough slightly larger than said filter sleeve for receiving said intermediate pin portion rearward of said annular collar flange means therethrough;

a tubular conductive shell having generally forward profiled means for engaging the first outward contact means and rearward profiled means for engaging the second outward contact means, and having a bore therethrough of stepped profile along the length thereof comprising a first portion of small diameter for receiving a forward end of said filter collar therein with clearance, and a second portion of a larger diameter joined to said first portion by a first annular step with said annular flange means of said filter collar abutting said first annular step, and said retaining ring being receivable in said second portion of said bore with a forward end of said retaining ring engaging said annular flange means of said collar, and with outer surfaces of said retaining ring engaging inner walls of said shell to electrically common said shell and said filter sleeve;

first dielectric means receivable within said shell forward of said first bore portion and having a bore for receiving a portion of said pin forward of said filter sleeve therethrough; and second dielectric means receivable within said shell rearward of said second bore portion, and having a bore for receiving a portion of said pin rearward of said filter sleeve therethrough.

* * * * *